US008287803B2

(12) United States Patent
Moore

(10) Patent No.: US 8,287,803 B2
(45) Date of Patent: Oct. 16, 2012

(54) BLASTER NOZZLE

(75) Inventor: M. David Moore, North Charleston, SC (US)

(73) Assignee: Wahl Refractory Solutions, LLC, Fremont, OH (US)

( * ) Notice: Subject to any disclaimer, the term of this patent is extended or adjusted under 35 U.S.C. 154(b) by 0 days.

(21) Appl. No.: 13/154,993

(22) Filed: Jun. 7, 2011

(65) Prior Publication Data

US 2011/0252622 A1 Oct. 20, 2011

Related U.S. Application Data

(62) Division of application No. 11/883,864, filed as application No. PCT/US2006/004659 on Feb. 9, 2006, now Pat. No. 7,968,047.

(60) Provisional application No. 60/651,823, filed on Feb. 10, 2005.

(51) Int. Cl.
*C21B 7/16* (2006.01)
*C21B 7/00* (2006.01)

(52) U.S. Cl. ..... 266/265; 266/266; 266/268; 266/270; 266/217; 266/225; 266/251; 110/182; 110/182.5

(58) Field of Classification Search ..... 266/265–266, 266/268, 270, 217, 225, 251; 110/182, 182.5
See application file for complete search history.

(56) References Cited

U.S. PATENT DOCUMENTS 2,007,676 A * 7/1935 Falla ..... 432/109
2,806,522 A 9/1957 Stalego
3,794,308 A 2/1974 Ponghis et al.
3,831,918 A 8/1974 Mori et al.
4,138,098 A * 2/1979 Leroy ..... 266/268
4,172,539 A 10/1979 Botkin
4,239,194 A 12/1980 Debaise
4,252,768 A 2/1981 Perkins et al.
4,326,701 A 4/1982 Hayden, Jr. et al.
4,366,255 A 12/1982 Lankard
4,510,191 A 4/1985 Kagami et al.
4,572,487 A 2/1986 Slagley
4,627,481 A 12/1986 Keisers et al.
4,742,995 A 5/1988 Bates
4,840,356 A 6/1989 Labate
4,923,665 A 5/1990 Andersen et al.
5,156,801 A 10/1992 Rothrock, Jr.
5,286,004 A 2/1994 Rothrock, Jr.
5,312,092 A 5/1994 Decker et al.
5,478,053 A 12/1995 Richter et al.
5,549,058 A 8/1996 Tutt
5,839,893 A 11/1998 Leibling (Continued)

FOREIGN PATENT DOCUMENTS

EP 0197306 A2 10/1986

(Continued)

*Primary Examiner* — Lois Zheng
(74) *Attorney, Agent, or Firm* — Pearne & Gordon LLP

(57) ABSTRACT

A novel blaster nozzle used for assisting in the pneumatic removal of cloggings and cakings during the transport of particulate matter through an enclosure housing is set such that it can be removed and replaced from outside the enclosure housing. The blaster nozzle includes a nozzle head having an orifice for the conduction of high-pressure fluid, wherein the nozzle head is composed of a refractory concrete having from about 4-20% by volume metal fibers therein. The blaster nozzle also includes a flange member connected to the nozzle head and a connection tube extends from the flange member for connecting the blaster nozzle to an air cannon.

17 Claims, 2 Drawing Sheets

U.S. PATENT DOCUMENTS

| | | | |
|---|---|---|---|
| 5,865,617 | A | 2/1999 | Rappen et al. |
| 5,884,851 | A | 3/1999 | Colavito et al. |
| 6,032,870 | A | 3/2000 | Simoens |
| 2002/0134791 | A1 | 9/2002 | Treat et al. |
| 2002/0140123 | A1 | 10/2002 | Krenchel et al. |

FOREIGN PATENT DOCUMENTS

| | | | |
|---|---|---|---|
| EP | 0565440 | A1 | 10/1993 |
| JP | 54004204 | | 1/1979 |
| JP | 60111747 | A | 6/1985 |

* cited by examiner

BLASTER NOZZLE

CROSS REFERENCE TO RELATED APPLICATION

The present application claims priority under 35 U.S.C. §119(e) to U.S. Provisional Patent Application No. 60/651, 823, filed Feb. 10, 2005.

BACKGROUND OF THE INVENTION

1. Field of the Invention

The invention relates to the art of replaceable nozzles, and more particularly, to replaceable air blaster nozzles for high temperature environments.

2. Description of Related Art

It is known to use blaster nozzles to conduct high pressure air from an air cannon to assist in the pneumatic removal of cloggings and cakings during the transport of particulate matter through hoppers, funnels, silos, enclosed conveyors, rotary kilns, and similar enclosures in cement production processes. The blaster nozzles are oriented either parallel or perpendicular to the interior wall of the enclosure and have proven particularly advantageous in helping to clear cakings and deposits that regularly build up in pipes, heat exchangers, and cyclones so that optimum heat exchange process and efficient transport of clinker and other heated particulate material can be achieved. These blaster nozzles commonly operate in environments having temperatures in excess of 1000° F. and even 2000° F.

Through the course of routine use, the mouthpiece of the blaster nozzle becomes worn or eroded by chemical reactions as a result of the extreme environment in which it operates. Therefore, blaster nozzles need to be periodically replaced. Typically, entry into the inside of the enclosure has been required in order to install the new blaster nozzle. The person performing the maintenance must remove the block material and the old nozzle, weld in a new nozzle and fill the hollow chamber with fireproof cement, resulting in a labor-intensive, high-risk evolution.

SUMMARY OF THE INVENTION

One aspect of the invention is directed to a blaster nozzle used for assisting in the pneumatic removal of cloggings and cakings during the transport of particulate matter through an enclosure housing. The blaster nozzle includes a nozzle head having an orifice for the conduction of high-pressure fluid, wherein the nozzle head is composed of a refractory concrete having from about 4-20% by volume metal fibers therein. The blaster nozzle also includes a flange member connected to the nozzle head and a connection tube extends from the flange member for connecting the blaster nozzle to an air cannon.

Another aspect of the invention is directed to a method for setting a blaster nozzle in a refractory lined enclosure housing so the blaster nozzle assists in the pneumatic removal of cloggings and cakings during the transport of particulate matter through the enclosure housing. The blaster nozzle is set so as to be removable and replaceable from outside the enclosure housing. The method includes forming a blaster nozzle having a cylindrical nozzle head defining an orifice for directing a high-pressure fluid, a flange member connected to the nozzle head, and a connecting tube extending from the flange member for connecting the blaster nozzle to an air cannon, wherein the nozzle head is composed of a refractory concrete having from about 4-20% by volume metal fibers therein. The method also includes cutting an opening in an outer shell of the enclosure housing and boring a hole in a refractory lining of the enclosure housing, said hole being sized to accommodate the nozzle head. The nozzle is installed by inserting the nozzle head into the bored hole such that the orifice is either protruding from or coterminous with an inside surface of the enclosure housing. The method also includes installing a filler to fill the gap between the outer circumference of nozzle head and the surface of the hole bored in the refractory lining. The flange is connected to the outer shell of the enclosure housing and the connecting tube is connected to an air cannon.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein:

FIG. 4 is a cross sectional view illustrating the disposition of the blaster nozzle of FIG. 1 in a refractory lined enclosure such as that existing in a feed conduit or the like.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
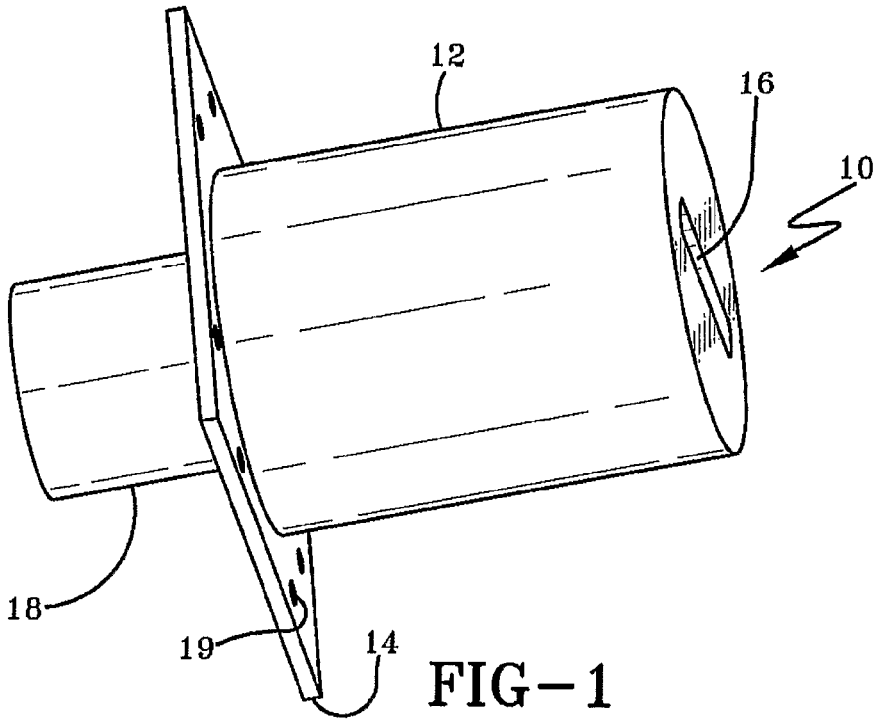
FIG. 1 is a side perspective view of one embodiment of a blaster nozzle in accordance with the invention.

Turning now to FIG. 1, there is shown a blaster nozzle 10 in accordance with the invention. The blaster nozzle 10 is of the type that may be operatively associated with an air cannon (not shown) to assist in the pneumatic removal of cloggings and cakings during the transport of particulate matter through hoppers, funnels, silos, enclosed conveyors, and the like. The nozzle 10 has proven particularly advantageous in helping to clear cakings and deposits in pipes, heat exchangers, and cyclones etc. in cement production processes wherein efficient transport of clinker and other heated particulate material is required. Advantageously, the blaster nozzle 10 according to the invention can be readily inserted into the desired enclosure from the outside of the enclosure as will be described below. Accordingly, entry into the inside of the enclosure is not required in order to replace the blaster nozzle 10.

The blaster nozzle 10 includes a generally cylindrical nozzle head 12 that is composed of cast refractory concrete. The blaster nozzle 10 also includes an integral flange member 14 connected to the nozzle head 12. Opposite the flange 14, an orifice 16 leads from the nozzle head 12. A connection tube 18 extends from the nozzle head 12 and is adapted for operative connection to a conventional air cannon (not shown). A plurality of apertures 19 can be provided in the flange 14 to facilitate connection of the flange to the steel or metal shell of an enclosure housing as will be shown herein.

Figure 2:
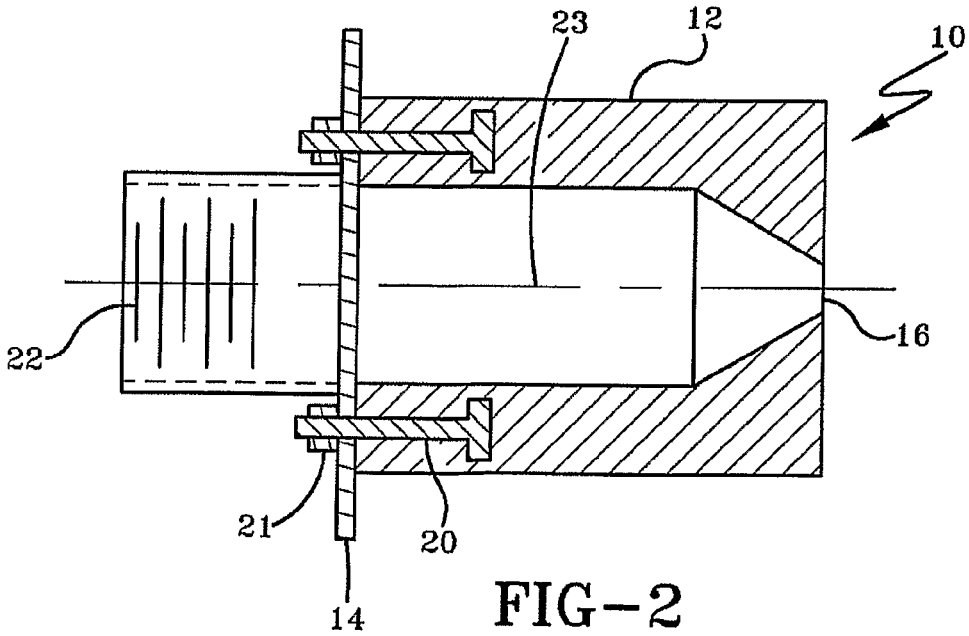
FIG. 2 is a cross section of the blaster nozzle shown in FIG. 1.

Referring now to FIG. 2, fasteners such as bolts 20 are desirably cast into the nozzle body 12 and corresponding nuts 21 are used to attach the flange 14 to the nozzle body. FIG. 2 also illustrates that the connection tube 18 may be provided with internal threads 22 or the like so as to readily connect to a manifold (not shown) of the air cannon or the like. However, one skilled in the art will appreciate that the connection tube 18 may be provided with external threads or may connect to the air cannon in any suitable manner. The longitudinal access of the air nozzle is shown at 23 and, as shown, the slotted orifice 16 disposed at the outlet end of head 12 is adapted to expel air from the air cannon along this longitudinal access 23 into the desired conduit or the like to aid in material transport. The interior of connection tube 18 is in fluid communication with the orifice 16.

The nozzle head 12 is composed of a cast, highly reinforced and heat-resistant refractory concrete having from about 4-20 volume % steel fibers therein. To date, excellent results have been shown when the nozzle 10 in accordance with the invention has been composed entirely of SIFCA® brand refractory concrete sold by Thermatex/Wahl Corporation of Fremont, Ohio and as described in commonly assigned U.S. Pat. No. 4,366,255. The entire disclosure of this patent is incorporated herein by reference. This product is a refractory concrete comprising calcium aluminate cement, aggregate, superplasticizer, and metal (steel) fibers. Aluminum-phosphate cement, gypsum and sodium silicate can also be used as the binder in these concretes. The refractory aggregate may be calcined mullite, kyanite, bauxite, and kaolin, among others. The refractory aggregate used in the present invention has a maximum particle size of about 35 mesh and is preferably 48 mesh or less. Desirably, the refractory concrete is formulated such that it remains fluid about one-half hour to one hour. In general these concretes are capable of withstanding temperatures up to 1620° C.

A variety of fibers and fiber sizes can be used to reinforce the aforementioned refractory concretes in the blaster nozzle 10. Some fibers will give better results than others. Naturally, the fibers must be stable under refractory conditions. Stainless steel fibers are preferred for many purposes. Carbon steel and other metal fibers can also be used. A pre-matted metal wool may be suitable in some applications. In general, the metal fibers may range in length from about ¾ to 2.0 inch (1.9 to 5.1 cm), have a diameter of from about 10 to 30 mils (0.25 to 0.75 mm) and possess an aspect ratio (length/diameter) greater than 50. Fibers outside this range can be used if care is taken to prevent local fiber-deficient pockets from occurring when placing the fibers in the mold.

Desirably, the nozzle head 12 is made of a refractory concrete that contains metal fiber in an amount greater than 4% by volume, preferably in an amount of about 4 to 20% by volume, and more preferably in an amount greater than 15%, for example, 15% to 20% by volume. In the method used to achieve these higher amounts of fiber, a superplasticizing agent is added to the slurry of the refractory material to better enable it to infiltrate the fibers and fill the mold. Suitable superplasticizers are sulfonated melamine formaldehyde and sulfonated naphthalene formaldehyde. The superplasticizers used in the present invention are those which enable the aqueous refractory slurry to fully infiltrate the packed fibers. Of those plasticizers that are commercially available, Mighty 150, a sulfonated naphthalene formaldehyde available from ICI is preferred.

The blaster nozzle head 12 is manufactured by preparing an aqueous slurry of a refractory concrete containing a superplasticizer and pouring it onto a bed of metal fibers in a mold while vibrating the mold. The refractory material is then allowed to harden, after which it is removed from the mold and dried to remove free and combined water.

The aqueous slurry is prepared by first mixing the refractory materials with the water and then, as a final mixing step, adding the superplasticizer. This mixing sequence has been found to produce the optimum fluidity when using the superplasticizers. The fluidity of the slurry must be such that it fully infiltrates the packed fiber bed using available forms of external vibration. In general, the water/cement ratios of the concretes used in the present invention will range from 0.5 to 0.8 by weight depending on the particle size gradation of the refractory mix and the cement content. Vibration is conducted in any convenient manner. It may be accomplished manually or using mechanical vibrators, several types of which are readily available. Generally, the vibrator used is a low frequency one and vibration is continued after adding the slurry to the mold. A removable plastic inner mold is used to form the orifice 16 through the nozzle head 12 connecting to the connecting tube 18.

Figure 3:
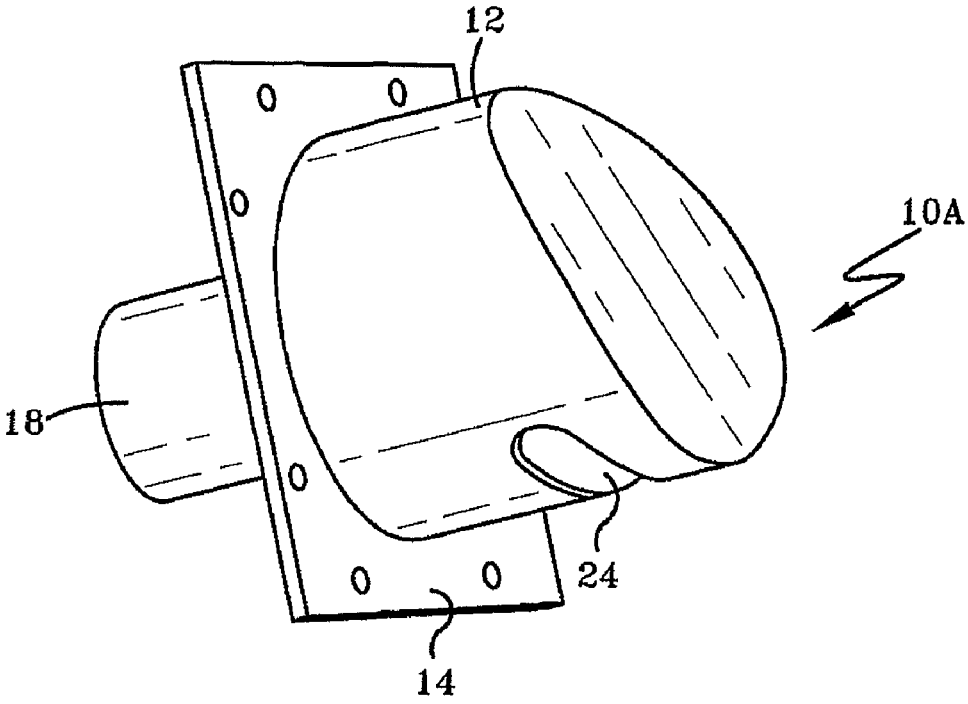
FIG. 3 is a side perspective view of another embodiment of a blaster nozzle in accordance with the invention.

FIG. 3 shows another embodiment of a blaster nozzle 10A wherein a radially disposed orifice 24 is provided. This orifice 24 provides for a radially extending exit, relative to the longitudinal access of the blaster nozzle, for the air emanating from the air cannon.

Figure 4:
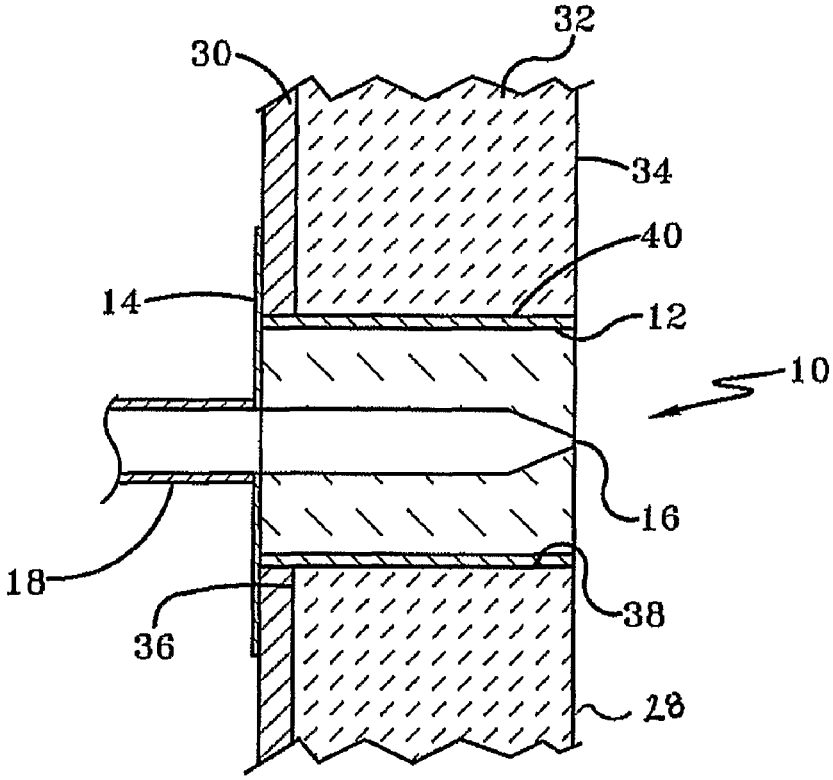

A method for installing and replacing the blaster nozzle 10 in a refractory lined housing 28 or the like is illustrated in conjunction with FIG. 4. Here, in order to install the nozzle 10, an appropriate opening is cut in a metal outer shell 30 of the housing 28. The refractory lining 32 is then bored at the required diameter and length as shown by reference number 38 so that it will accommodate the nozzle head 12 in the refractory with the slotted orifice 16 protruding from or being coterminous with the inside surface 34 of the housing 28. The counter bore hole 38 made through the refractory lining 32, is, as aforementioned, provided with requisite dimensions so as to provide for a snug fit of the nozzle head 12 therein with the orifice 16 positioned adjacent the inside surface 34 so that it may provide appropriate air blast therethrough to aid in transport of the desired particulate matter. Accordingly, the bore hole 38 in the refractory lining 32 desirably has a shape corresponding to the shape of the nozzle head 12 with dimensions between about 0.25 and 0.75 inches (0.64 and 1.9 cm) larger than the nozzle head. In the illustrated embodiment, the cylindrical nozzle head 12 has a diameter of about 11.5 inches (29.2 cm) and the opening has a diameter of about 12.0 inch (30.5 cm). However, one skilled in the art will understand that the above dimensions are given for exemplary purposes only, and other dimensions for the nozzle head 12 and bore hole 38 may be used. A filler is used to fill the gap between the outer circumference of nozzle head 12 and the surface of the hole 38 bored in the refractory lining 32. In one desirable embodiment, the filler 40 is a heat setting mortar inserted between the nozzle head 12 and the refractory lining 32. Alternately, the nozzle head 12 may be wrapped with a heat resistant tape to fill the gap between the nozzle head 12 and the refractory lining 32.

The flange 14 may be welded, bolted, or otherwise attached to the metal shell 30. In some cases, it will be desirable to weld cross bar studs over a portion of the bore hole 36 formed in the shell to provide for a secure weld of the flange 14 thereto. In order to replace the nozzle 10, the flange is separated from the metal shell 30 by cutting the weld, removing the bolts, or otherwise separating the flange from the shell. The nozzle 10 is then pulled out of the bore hole 38 and a new nozzle is inserted as described above. Therefore, replacing the nozzle 10 does not require entry into the enclosure.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A method of installing a blaster nozzle in a refractory lined enclosure housing, the blaster nozzle being effective to assist in the pneumatic removal of cloggings and/or cakings during the transport of particulate matter through the enclosure housing, the method comprising:

(a) providing, outside an outer shell of the enclosure housing, the blaster nozzle, the blaster nozzle comprising a nozzle head, a flange member and a connection tube, the flange member being connected to the nozzle head, the connection tube extending from the flange member for connecting the blaster nozzle to an air cannon, the nozzle head comprising a refractory concrete having about 4-20% by volume metal fibers therein, the nozzle head having an inner surface which defines a passageway extending from adjacent the flange member for conduction of, and contact with, high-pressure air, the nozzle head having an orifice at a distal end of the passageway where high-pressure air is expellable from the blaster nozzle, at least a majority of said inner surface being said refractory concrete, the nozzle head having an outer surface of said refractory concrete, the orifice, including the inner and outer surfaces thereof, being made entirely of said refractory concrete, the enclosure housing, including the outer shell thereof, having a hole sized to accommodate the blaster nozzle;

(b) from outside the outer shell and through the hole in the outer shell, installing the blaster nozzle into the hole; and (c) attaching the flange member to the outer shell.

2. The method of claim 1, further comprising connecting the connection tube to the air cannon.

3. The method of claim 1, wherein the flange member is attached to the outer shell by welding.

4. The method of claim 1, wherein the outer shell is metal.

5. The method of claim 1, further comprising installing a filler to fill a gap between the outer surface of the nozzle head and an inner surface of the hole.

6. The method of claim 1, wherein the blaster nozzle is installed into the hole by inserting the blaster nozzle into the hole orifice-end first.

7. The method of claim 1, wherein the enclosure housing is selected from the group consisting of hoppers, funnels, silos, enclosed conveyors, and rotary kilns.

8. The method of claim 1, wherein the enclosure housing is an enclosure housing in a cement production process.

9. The method of claim 1, wherein the enclosure housing is a rotary kiln.

10. The method of claim 1, wherein the enclosure housing is a rotary kiln for cement production.

11. The method of claim 1, wherein the nozzle head is effective to operate in an environment having temperatures in excess of 2000° F.

12. The method of claim 1, wherein the nozzle head is effective to withstand temperatures of up to 1620° C.

13. The method of claim 1, further comprising, prior to step (b), removing a different blaster nozzle from the enclosure housing to provide the hole.

14. The method of claim 13, wherein the different blaster nozzle is removed from outside the outer shell by passing an orifice-end of the different blaster nozzle through the hole in the outer shell.

15. The method of claim 1, wherein the nozzle head is cylindrical.

16. The method of claim 1, wherein the flange member is connected to the nozzle head by means comprising fasteners cast into the nozzle head.

17. The method of claim 1, wherein the orifice is a slotted orifice.

* * * * *